US005702022A

United States Patent [19]

Umiker

[11] Patent Number: 5,702,022

[45] Date of Patent: Dec. 30, 1997

[54] BOTTLE CRATE

[75] Inventor: Hans Umiker, Egg, Switzerland

[73] Assignee: Schoeller-Plast S.A., Romont, France

[21] Appl. No.: 637,079

[22] Filed: Apr. 24, 1996

[30] Foreign Application Priority Data

Apr. 26, 1995 [CH] Switzerland ..... 1193/95

[51] Int. Cl.[6] ..... B65D 1/24; B65D 1/36; B65D 25/04; B65D 85/00

[52] U.S. Cl. ..... 220/509; 206/203; 206/427; 220/516; 220/518; 220/DIG. 2; 220/DIG. 15

[58] Field of Search ..... 220/509, 513, 220/514, 515, 516, 518, DIG. 2, DIG. 15; 206/203, 427; 217/19

[56] References Cited

U.S. PATENT DOCUMENTS

| | | | |
|---|---|---|---|
| 1,480,921 | 1/1924 | Weinmann | 217/19 |
| 2,917,183 | 12/1959 | Seelye | 217/19 |

FOREIGN PATENT DOCUMENTS

| | | |
|---|---|---|
| 0 306 783 | 3/1989 | European Pat. Off. . |
| 0 367 168 | 5/1990 | European Pat. Off. . |
| 1.522.091 | 1/1968 | France . |
| 380124 | 4/1989 | Germany . |

*Primary Examiner*—Stephen P. Garbe
*Assistant Examiner*—Niki M. Kopsidas
*Attorney, Agent, or Firm*—Cushman Darby & Cushman Intellectual Property Group of Pillsbury Madison & Sutro LLP

[57] ABSTRACT

The positioning compartments of a bottle crate are divided in a transverse direction by transverse dividing elements which include supporting projections with hollows halfway up, and dividing tongues which project downwards in an elastically deformable manner below them. Arranged opposite the supporting projections, on an outer wall, are supporting fingers. If the bottle crate is placed on one of the outer walls while containing bottles, each lower bottle tilts about a support formed by the supporting fingers, the bottom of the bottle being displaced in the process against the respective outer wall, and each upper bottle is likewise tilted, about a support formed by the hollows, into a position in which it is secured against sliding out of the respective positioning compartment, this tilting movement involving deformation of the respective dividing tongue. Each dividing tongue is located between the respective bottles at all times and prevents them from banging against one another.

10 Claims, 3 Drawing Sheets

BOTTLE CRATE

BACKGROUND OF THE INVENTION

The invention relates to a bottle crate of a kind which is used, in particular, for transporting and storing wine bottles. Whereas wine bottles are preferably transported upright, they should not be stored for long in this position if they are sealed with corks since, otherwise, there is the risk that the cork will dry out and become permeable to air, so that the wine oxidizes. Bottle crates of conventional design, such as those which are used for transporting and storing beer bottles, mineral-water bottles and other bottles sealed with crown corks or screw caps, are not suitable for the horizontal storage of bottles, however, since, if the bottle crate is tipped onto one side wall, the bottles can easily slide forwards out of their positioning compartments. For this reason, special bottle crates have long been available. In these crates, bottles can be stored horizontally in such a way that the bottom of the bottle is at a somewhat lower level and the neck of the bottle is somewhat raised, providing a threshold to prevent the bottle from sliding out.

Thus, for example, FR-A-1 522 091 has disclosed a bottle crate with a compartment structure, the dividing walls of which are provided with trapezoidal recesses which widen towards the bottom and into which the bottles slide when the bottle crate is tipped onto one side wall. Although this ensures that the horizontal bottles are held securely, they can be knocked together and damaged by jolts during transport, for example, because the recesses are relatively large.

EP-A-0 306 783 has disclosed a bottle crate in which the bottom of the bottle can be displaced sideways out of an initial position, which it occupies when the bottle is vertical, when the bottle crate is tipped onto one side wall, and, in the process, the bottle can be tilted about a supporting ledge formed halfway up it or is held in the position described above by supporting strips. The bottles are always reliably separated, and it is thus not possible for them to damage one another. This essentially well-proven solution is relatively complicated and expensive to manufacture.

SUMMARY OF THE INVENTION

Faced with this situation, the object on which the invention is based is to specify a bottle crate of the latter type which can be manufactured in a simple manner and with little outlay.

The invention provides a simple bottle crate which is easy to manufacture, reliably separates the wine bottles and does not allow them to strike against one another, especially during transport, but in which they are reliably held fast even in a horizontal position, so that there is no danger that the bottles will slide out. Moreover, despite the lateral freedom of movement required for the bottoms of the bottles, the structure of the bottle crate is very space-saving.

BRIEF DESCRIPTION OF THE DRAWINGS

The invention is explained in greater detail below with reference to attached drawings which show just one exemplary embodiment. In the Drawings.

DETAILED DESCRIPTION

Figure 1:
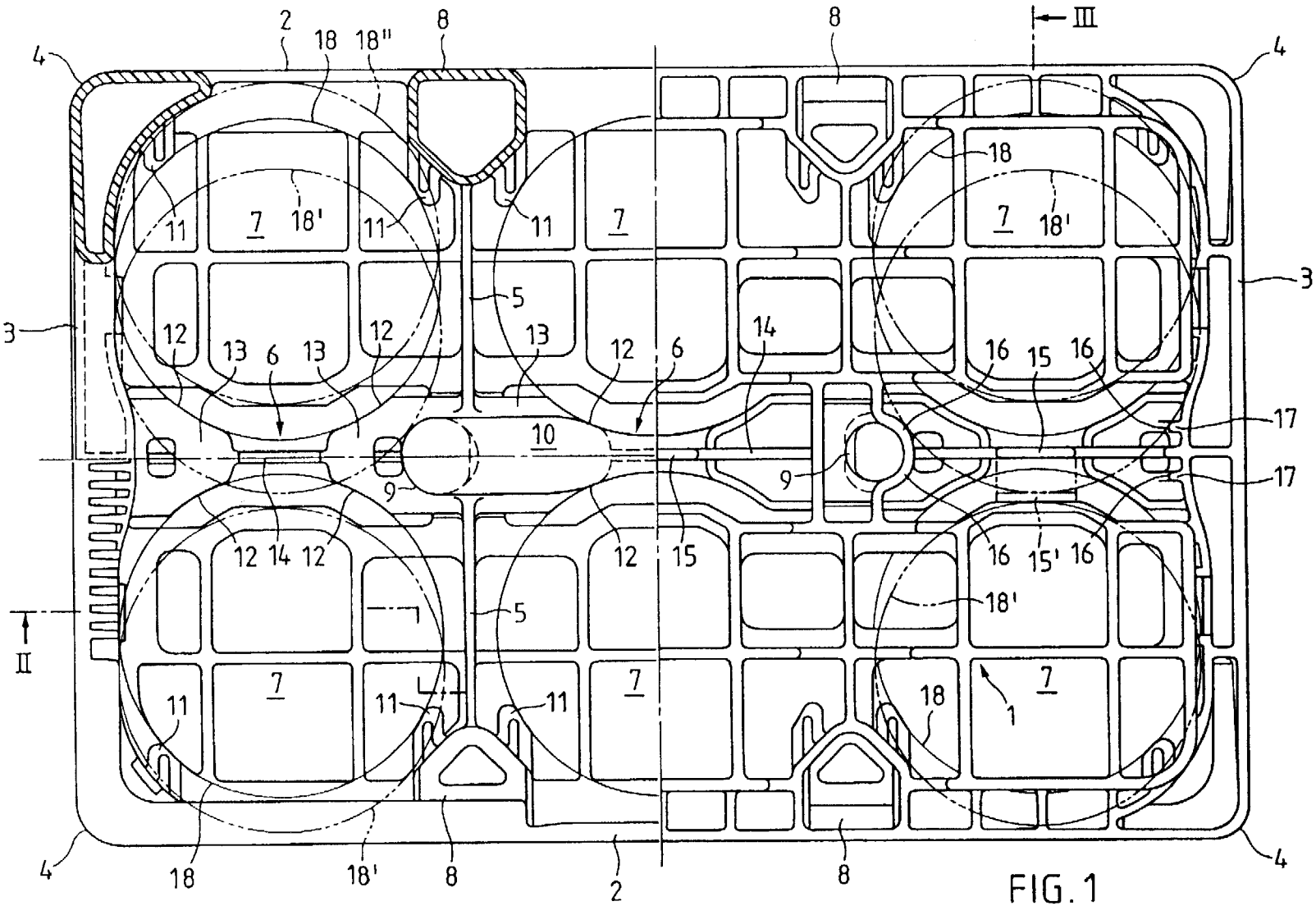
FIG. 1 shows, on the left, a plan view, partially sectioned on line I—I of FIG. 2, and, on the right, a bottom view of a bottle crate according to the invention.
Figure 2:
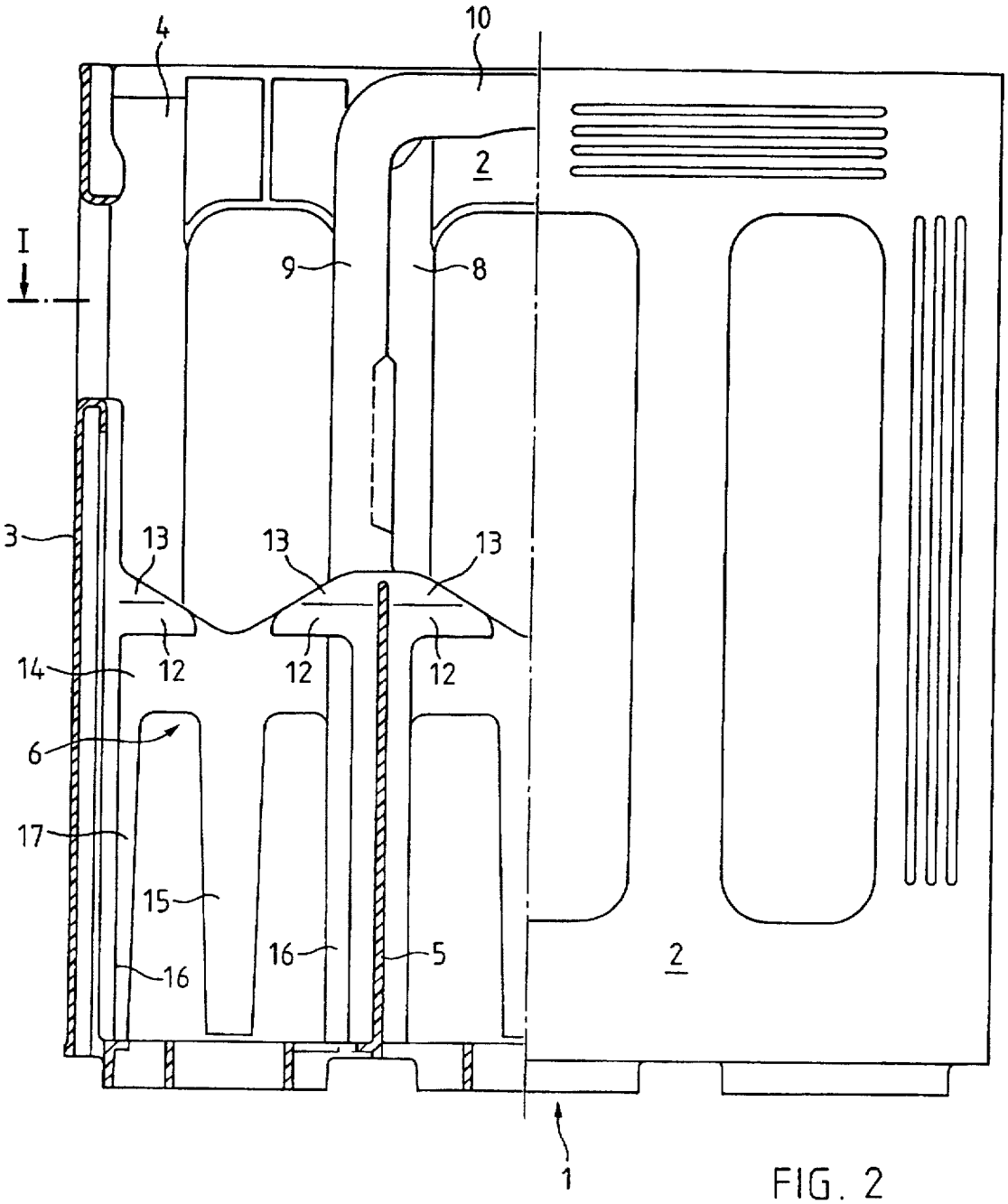
FIG. 2 shows a side view, partially sectioned on line II—II of FIG. 1, of the bottle crate in FIG. 1

The bottle crate has a bottom which is formed by a bottom grid 1, and two outer walls 2 running in the longitudinal direction and two outer walls 3 running in the transverse direction, these walls being connected by corner members 4. The space enclosed by them is divided into three positioning compartments 7 in the longitudinal direction and into two in the transverse direction by longitudinal dividing elements 5 and transverse dividing elements 6. The longitudinal dividing elements 5 are designed as solid continuous dividing walls of about half height which each connect an outer member 8 formed integrally on the inside of the outer wall 2 to an inner member 9 surrounded by four positioning compartments 7. The two inner members 9 are connected by a carrying handle 10 which does not project above the outer walls 2, 3.

Each positioning compartment 7 has supports which lie opposite one another and act in the transverse direction. On the outer wall 2, the support is in each case formed by two supporting projections which are arranged on both sides in the vicinity of the longitudinal dividing elements 6 or the outer wall 3, project transversely into the positioning compartment 7 from the corner member 4 or the outer member 8, about halfway up, and are designed as narrow supporting fingers 11. The support on the opposite transverse dividing element 6 is formed by two supporting projections which are arranged at the same level and each have hollows 12. Mutually adjoining supporting projections arranged on both sides of the transverse dividing element 6 and projecting into adjacent positioning compartments 7 together form respective noses 13 which project between the adjacent positioning compartments 7 from an outer wall 2 or an inner member 9. Two mutually facing noses 13 are in each case connected by a wall strip 14, from the bottom edge of which a dividing tongue 15 projects downwards almost as far as the bottom grid 1. The dividing tongue 15 is relatively thin and elastically deformable.

Stop strips 16 extend down to the bottom grid 1 on both sides of the dividing tongue 15, with a clearance relative to the latter. They are formed by the inner member 9 and—at the outer wall 3—a web 17, the width of which decreases slightly in the downward direction, with the result that the stop strips 16 run slightly away from one another.

Figure 3:
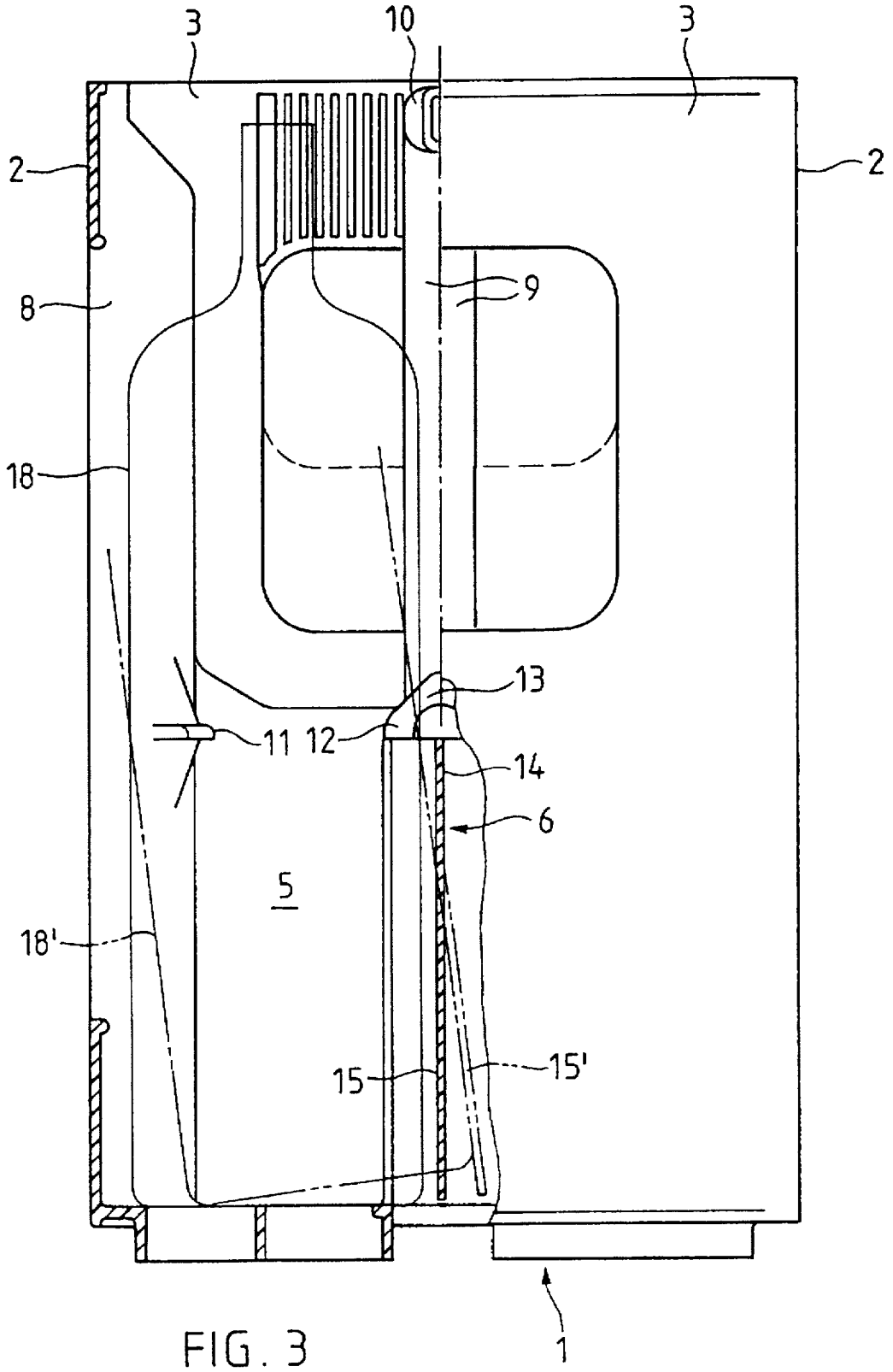
FIG. 3 shows a front view, partially sectioned on line III—III of FIG. 1, of the bottle crate in FIG. 1.

With the bottle crate in the vertical position, a bottle 18 is held fast in the position represented in solid lines in FIGS. 1, 3 in one of the positioning compartments 7 by the supporting projections. If the bottle crate is tipped onto the outer wall 2 at the bottom in FIG. 1, the bottom of the lower bottle in each case slips into the position 18' drawn in broken lines (see FIG. 1, bottom right), in which it abuts the inside of the outer wall 2. During this process, it tilts about the support formed by the supporting fingers 11, which is of course arranged in such a way that the centre of gravity of the bottle is lower than the support, and, as a result, moves into a gently inclined position, in which the neck of the bottle is somewhat higher than the bottom of the bottle.

In a corresponding manner, the bottom of the bottle 18 positioned in the positioning compartment 7 above (top right in FIG. 1) likewise slips downwards into the position 18' indicated in broken lines, the circumferential surface of the bottle pushing the dividing tongue 15 downwards, deforming it elastically as it does so, into the position 15', likewise indicated in broken lines (see also FIG. 3). It can rest lightly on the lower bottle. However, the downward movement of the bottom of the bottle is in all cases limited by the stop strips 16, the spacing of which is significantly smaller than the diameter of the bottle.

Although the bottom part of the upper bottle can project into the positioning compartment 7 below, and, as can be seen from FIG. 1, its position in fact overlaps in a space-saving manner with the initial position of the lower bottle, that occupied by the latter when the bottle crate is upright, the displacement is limited by the stop strips 16. Furthermore, the bottles can never come into contact since the dividing tongue 15 always lies between them.

If the bottle crate is set upright again, the bottles tend to reassume their initial positions, particularly when subjected to the effect of any jolts which may occur, and this process is in part assisted by the elastically deformed dividing tongues 15. In all cases, adjacent bottles are reliably prevented from banging against one another by the dividing tongues 15, in the upright position of the bottle crate as well, even if the bottles 18 are not in the initial positions.

If the bottle crate is placed on the opposite outer wall 2, the top wall in FIG. 1, the bottles 18 are displaced in a fully corresponding manner. The upper bottle, which in this case is at the bottom, assumes the position 18", and the lower bottle, which is then at the top, changes its position accordingly.

The solution described can, of course, also be applied in the case of larger bottle crates. It can also be applied more generally insofar as it is possible, with slight modifications, to make the longitudinal dividing elements the same as the transverse dividing elements, thus ensuring the function according to the invention irrespective of which of the outer walls the bottle crate is tipped onto.

I claim:

1. A bottle crate, comprising:

a bottom;

two pairs of mutually opposed outer walls including two longitudinal outer walls and two transverse outer walls, which are upstanding and joined to the bottom at an outer perimeter of the bottom, and to respective perimetrically neighboring ones of said outer walls, at respective corners;

a plurality of longitudinal dividing elements and a plurality of transverse dividing elements by which a space bounded by said outer walls and said bottom is divided into a plurality of adjoining positioning compartments in a longitudinal direction and a plurality of adjoining positioning compartments in a transverse direction;

said positioning compartments each having, a plurality of supports located at a level, assuming an upright position of said crate, which is above said bottom by an amount which is further above said bottom than a given distance, which given distance is equal to the height from said bottom of the center of gravity of each of a plurality of like liquid-continuing closed bottles having respective bottoms and a predetermined weight distribution and intended to be at least one of transported and stored in said crate, which act in the transverse direction towards the interior of the respective said positioning compartment and which, at a respective said outer wall limiting the respective said positioning compartment in the transverse direction, project beyond the bottom of the respective said positioning compartment, so that respective supports are arranged to hold fast a respective said bottle when said bottle is standing in the respective said positioning compartment in a position in which the respective said bottle can be tilted about a respective said support when the bottle crate is placed on a respective said outer wall, the bottom of the respective said bottle being displaced, as the crate is tilted from said upright position onto a respective said outer wall, against the respective said outer wall;

said transverse dividing elements having, at least in a respective region of each located close to said bottom of said crate, dividing elements that are movable in said transverse direction, allowing a respective said bottle when standing in a respective said positioning compartment to be tilted about the respective said support thereby displacing the bottom of the respective said bottle and moving the respective said dividing element towards a respectively adjacent said positioning compartment as the bottle crate is placed on the respective said outer wall.

2. The bottle crate according to claim 1, wherein:

said dividing elements are each elastically bendable or deformable.

3. The bottle crate according to claim 2, wherein:

said dividing elements are each attached, at respective attachments, to structure of said crate at a respective upper end thereof and projects freely from the respective said attachments towards said bottom of said crate.

4. The bottle crate according to claim 3, wherein:

said dividing elements are provided as respective elongated dividing tongues.

5. The bottle crate according to claim 1, for use where said bottles each have a body having a given diameter wherein:

said transverse dividing elements have, respective regions close to said bottom of said crate, respective stops which are arranged on both sides of the respective said dividing element and which limit displacement of the bottom of the respective said bottle towards a respective adjacent said position compartment, spacing between respective said stops being less than the diameter of the respective said bottle body.

6. The bottle crate according to claim 5, wherein:

stops are constituted by respective at least approximately vertical stop strips.

7. The bottle crate according to claim 6, wherein:

respective said stop strips are arranged on both sides of the respective said dividing elements, with a clearance relative to the respective ones of said dividing elements.

8. The bottle crate according to claim 7, wherein:

spacing is provided between respective ones of siad stop strips which increases slightly towards said bottom of said crate.

9. The bottle crate according to claim 1, wherein:

each said support is provided by a respective pair of supporting projections which project transversely into the respective said positioning compartment from opposite sides of the medium of the respective said positioning compartment.

10. The bottle crate according to claim 1, wherein:

said longitudinal dividing elements are provided as respective solid dividing walls.

* * * * *